US010596531B1

(12) United States Patent
Ellis

(10) Patent No.: US 10,596,531 B1
(45) Date of Patent: Mar. 24, 2020

(54) MODULAR CONTINUOUS ADHESIVE FOAM MIXER

(71) Applicant: Michael A. Ellis, Chattanooga, TN (US)

(72) Inventor: Michael A. Ellis, Chattanooga, TN (US)

( * ) Notice: Subject to any disclaimer, the term of this patent is extended or adjusted under 35 U.S.C. 154(b) by 0 days.

(21) Appl. No.: 15/484,904

(22) Filed: Apr. 11, 2017

Related U.S. Application Data

(60) Provisional application No. 62/325,987, filed on Apr. 21, 2016.

(51) Int. Cl.
*B01F 7/00* (2006.01)
*B01F 3/04* (2006.01)
*B01F 7/10* (2006.01)

(52) U.S. Cl.
CPC ..... *B01F 7/00841* (2013.01); *B01F 3/04453* (2013.01); *B01F 7/0045* (2013.01); *B01F 7/00633* (2013.01); *B01F 7/10* (2013.01); *B01F 2215/006* (2013.01)

(58) Field of Classification Search
CPC ..... B01F 7/00766
USPC ..... 261/83, 84; 366/290, 304
See application file for complete search history.

(56) References Cited

U.S. PATENT DOCUMENTS 998,762 A 7/1911 Faller
2,202,176 A 5/1940 Timpson
2,627,394 A * 2/1953 Spencer ..... B01F 3/04453 241/154
2,639,901 A * 5/1953 Teale ..... B01F 7/00758 241/188.2
2,641,453 A * 6/1953 Teale ..... B01F 7/00758 241/188.2
2,706,108 A * 4/1955 Miner ..... B01F 7/00766 239/142
3,081,069 A * 3/1963 Oakes ..... B01F 7/00766 159/25.2
3,231,242 A * 1/1966 Schrier ..... B01F 7/00766 366/304
3,322,684 A * 5/1967 Gibson ..... B01F 3/04453 239/343
4,131,658 A 12/1978 Hirata et al.
4,915,509 A * 4/1990 Sauer ..... B01F 5/0683 366/149
5,427,181 A 6/1995 Laskaris et al.
5,837,168 A 11/1998 Rowe
(Continued)

*Primary Examiner* — David L Sorkin
(74) *Attorney, Agent, or Firm* — Quickpatents, LLC; Kevin Prince

(57) ABSTRACT

A modular continuous mixer includes a rigid casing having an inlet adjacent to an annular inlet end thereof and an outlet adjacent an opposing annular outlet end thereof. The casing further includes a cylindrical exterior casing wall that, together with the ends, define a volume therein. The ends each include a plurality of concentric rings of mixing pins projecting into the volume. One or more rotor disks are rotationally fixed within the casing between distal ends of the opposing pins. Each rotor disk includes a plurality of the concentric rings of mixing pins projecting from both sides thereof toward the inlet and outlet ends. A drive shaft is rotatably mounted in the casing and fixed through the center of each rotor disk. Additional casing extensions can be mounted between the inlet and outlet ends of the casing to facilitate further mixing.

12 Claims, 3 Drawing Sheets

(56) References Cited

U.S. PATENT DOCUMENTS

| | | | | |
|---|---|---|---|---|
| 5,931,579 | A * | 8/1999 | Gallus | B01F 7/00766 366/163.2 |
| 6,086,052 | A | 7/2000 | Rowe | |
| 8,079,752 | B2 * | 12/2011 | Rausch | B01F 7/00766 366/178.2 |
| 8,702,298 | B2 * | 4/2014 | Sei | B01F 3/0807 366/136 |
| 2009/0262598 | A1 | 10/2009 | Brashears | |

* cited by examiner

MODULAR CONTINUOUS ADHESIVE FOAM MIXER

CROSS-REFERENCE TO RELATED APPLICATIONS

This application claims the benefit of U.S. Provisional Patent Application 62/325,987, filed on Apr. 21, 2016, and incorporated herein by reference.

STATEMENT REGARDING FEDERALLY SPONSORED RESEARCH AND DEVELOPMENT

Not Applicable.

FIELD OF THE INVENTION

This invention relates to mixing devices, and more particularly to a modular latex adhesive foam generator.

DISCUSSION OF RELATED ART

Adhesive foam mixers are known in the art for mixing adhesive foam compounds for use with carpet manufacturing. Prior art devices are notorious for failing during, often requiring extensive repairs and extended down-time on the manufacturing line. Further, multiple such prior art devices are often needed to obtain a suitable level of mixing of the adhesive compound with air to generate the adhesive foam, which is expensive.

Therefore, there is a need for a device that effectively and efficiently mixes the adhesive compound and air to create the adhesive foam. Such a needed invention would be modular, allowing additional casing extensions to be added in order to increase the number of mixing pins and surface area of mixing elements within the volume of the device. Such a needed device would be relatively easy to repair in the field and require little down-time on the manufacturing line when elements of the mixer break and need to be replaced. The present invention accomplishes these objectives.

SUMMARY OF THE INVENTION

The present device is a continuous mixer for mixing an adhesive compound with air to produce an adhesive foam. A rigid casing has an inlet adjacent to an annular inlet end thereof and an outlet adjacent an opposing annular outlet end thereof. The casing further includes a cylindrical exterior casing wall that, together with ends, define a volume therein. The inlet end and the outlet end each include a plurality of concentric rings of mixing pins projecting into the volume.

At least one rotor disk is rotationally fixed within the casing between distal ends of the opposing pins. The at least one rotor disk includes a plurality of the concentric rings of mixing pins projecting from both sides thereof toward the inlet and outlet ends. The concentric rings of the rotor disk are situated between the concentric rings of the inlet and outlet ends.

A drive shaft is rotatably mounted in the casing and fixed through the center of each of the at least one rotor disk. The drive shaft includes at least one rotational seal that prevents the adhesive compound from escaping the casing. A plurality of roller bearings rotationally support the drive shaft and the at least one rotor disk within the casing.

As such, with a mixture of air and the adhesive compound introduced into the inlet and with the drive shaft rotationally coupled to a motor, the adhesive compound and the air are thoroughly mixed into the adhesive foam as the mixture travels from the inlet between the pins of the inlet end and the opposing pins of the rotor, around a peripheral edge of the rotor disk, and back through the rotating pins of the rotor disk and the opposing pins of the outlet side of the casing towards the drive shaft, thereupon exiting the mixer through the outlet.

Additional casing extensions can be mounted between the inlet and outlet ends of the casing. Each casing extension includes a cylindrical extension wall and a middle annulus projecting inwardly from the extension wall. The middle annulus includes a central aperture for accommodating the drive shaft therethrough and has a plurality of the concentric rings of the mixing pins projecting towards the inlet and outlet ends. The drive shaft, in such an embodiment, is further connected with an additional rotor disk rotationally fixed within the casing between distal ends of the opposing pins of the middle annulus and the outlet end. The additional rotor disk includes a plurality of the concentric rings of mixing pins projecting from both sides thereof towards the middle annulus and the outer end. The concentric rings of the additional rotor disk are situated between the concentric rings of the middle annulus and the outlet end. As such, the adhesive compound and air mixture must travel around the peripheral edge of each rotor disk, and through the aperture of the middle annulus before existing the mixer.

In one embodiment, the leading edge of each of the pins of each rotor disk are concave to further agitate the mixture of the adhesive compound and the air. Each of the roller bearings is preferably removably mounted to the casing, such that when the outlet end of the casing is disassembled from the inlet end of the casing, the rotor disk and roller bearings can be removed from the casing. A mounting frame may be fixed with the inlet end of the casing and include at least one roller bearing for rotationally receiving the drive shaft therethrough. Such a mounting frame further includes a plurality of mounting apertures for mounting the mixer on a flat surface, such as a table or workbench.

The present invention is a device that effectively and efficiently mixes the adhesive compound and air to create the adhesive foam. The present device is modular, allowing additional casing extensions to be added in order to increase the number of mixing pins and surface area of mixing elements within the volume of the device, as desired. The present invention is relatively easy to repair in the field and requires little down-time on the manufacturing line if elements of the mixer break and need to be replaced. The mixer of the present invention is modular, making it simple to change components to adjust performance as desired by the user when needed. The instant invention is simple to disassemble and service and made in a way that the person performing the repair or cleaning cannot assemble the mixer incorrectly, which with prior art devices results in damage to the moving parts or the primary seal where the drive shaft enters into the mixing assembly to turn the rotating parts. Furthermore the present mixer can include two or more rotating rotor disks having the raised pins to mix the latex slurry and air together to create a desired foam density. With two rotor disks the throughput capability is greatly increased over a single rotor disk configuration. Having a completely modular design and twice the mixing area results in ease-of-operation and easy maintenance. With a relatively large mixing volume a slower RPM is possible on the motor, preserving motor life, while producing better foam structure and extending the life of the seal. Changes to the mixer are simple as compared to previous designs that require machining and permanent modifications, often which require the owner acquiring multiple units. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
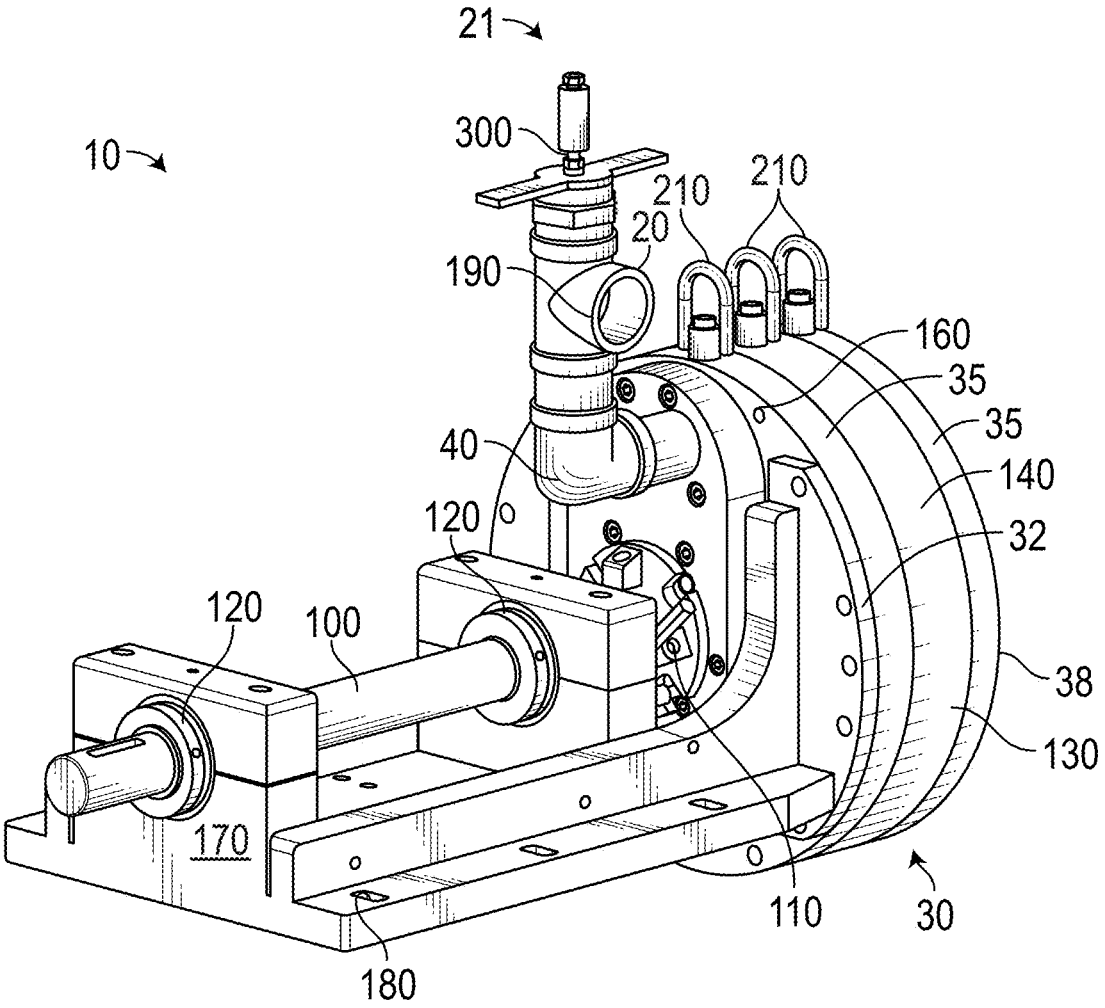
FIG. 1 is a perspective view of the invention.
Figure 2:
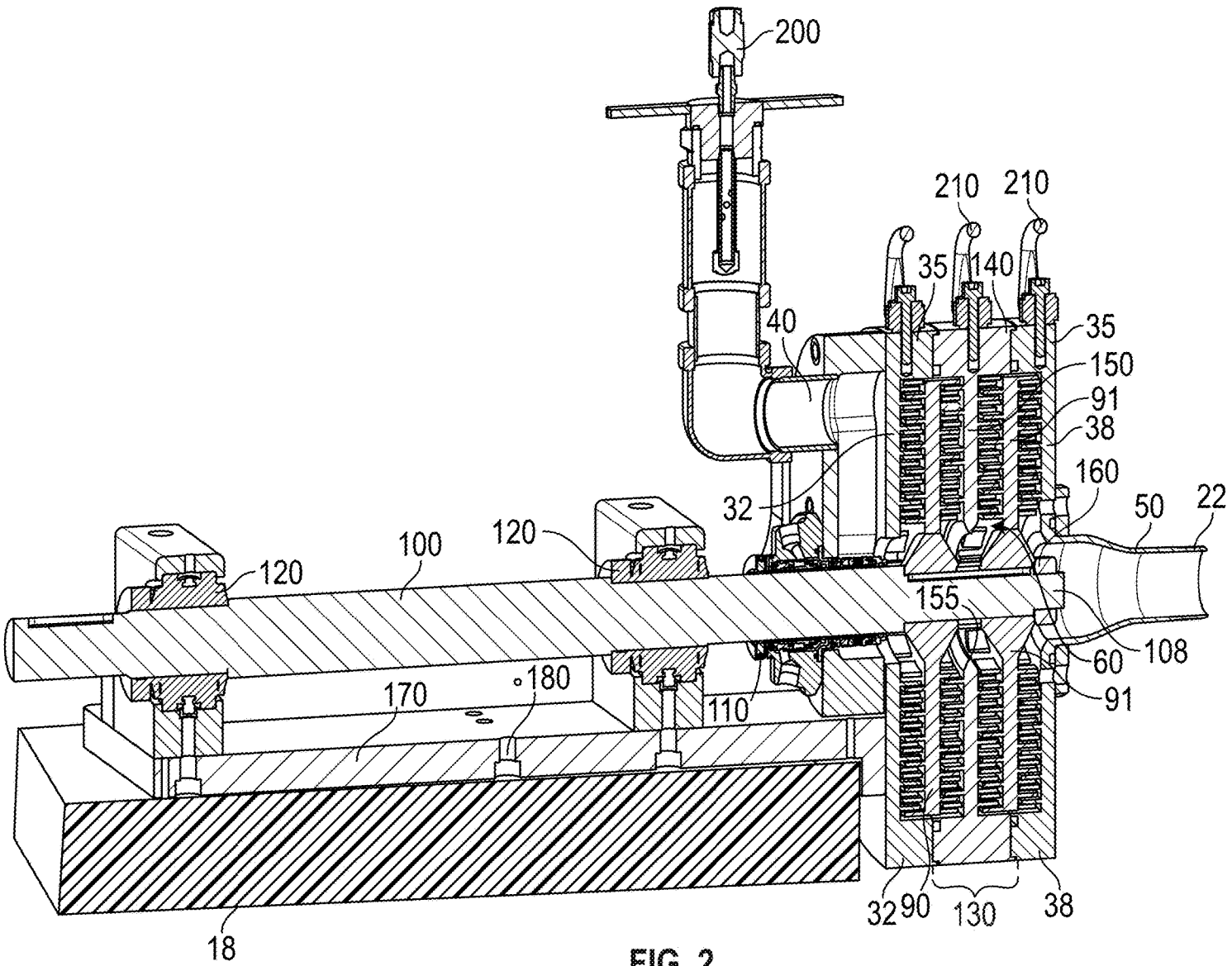
FIG. 2 is a cross-sectional view of the invention.
Figure 3:
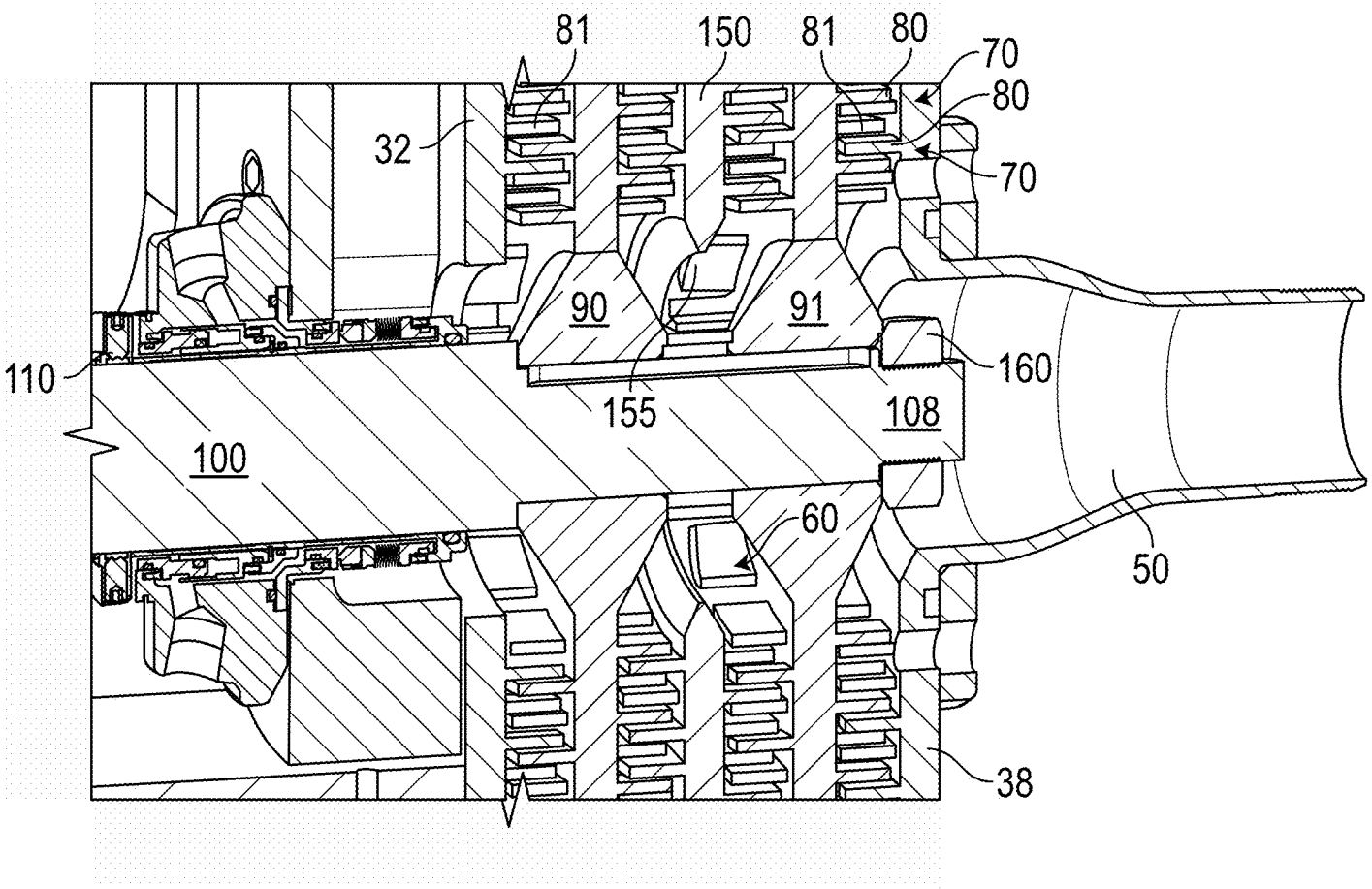
FIG. 3 is a partial, enlarged cross-sectional view of the invention.

FIGS. 1-3 illustrate a continuous mixer 10 for mixing an adhesive compound 20 with air 21 to produce an adhesive foam 22. Such an adhesive compound 20 may be a latex adhesive, for example, having a viscosity of between 3,000 to 20,000 cps.

A rigid casing 30 has an inlet 40 adjacent to an annular inlet end 32 thereof and an outlet 50 adjacent an opposing annular outlet end 38 thereof. The casing 30 further includes a cylindrical exterior casing wall 35 that, together with ends 32,38 define a volume 60 therein. The inlet end 32 and the outlet end 38 each include a plurality of concentric rings 70 of mixing pins 80 projecting into the volume 60. Preferably the casing 30 comprises two separate pieces, the inlet end 32 and the outlet end 38, that are fixed together with a plurality of mechanical fasteners 160 such as screws or bolts.

At least one rotor disk 90 is rotationally fixed within the casing 30 between distal ends 88 of the opposing pins 80. The at least one rotor disk 90 includes a plurality of the concentric rings 70 of mixing pins 80 projecting from both sides thereof toward the inlet and outlet ends 32,38. The concentric rings 70 of the rotor disk 90 are situated between the concentric rings 70 of the inlet and outlet ends 32,38 (FIG. 3).

A drive shaft 100 is rotatably mounted in the casing 30 and fixed through the center 94 of each of the at least one rotor disk 90. The drive shaft 100 includes at least one rotational seal 110 that prevents the adhesive compound 20 from escaping the casing 30. A plurality of roller bearings 120 rotationally support the drive shaft 100 and the at least one rotor disk 90 within the casing 30.

As such, with a mixture of air 21 and the adhesive compound 20 introduced into the inlet 40 and with the drive shaft rotationally coupled to a motor or other rotational energy source (not shown), the adhesive compound 20 and the air 21 are thoroughly mixed into the adhesive foam 22 as the mixture travels from the inlet 40 between the pins 80 of the inlet end 32 and the opposing pins 80 of the rotor 90, around a peripheral edge 95 of the rotor disk 90, and back through the rotating pins 80 of the rotor disk 90 and the opposing pins 80 of the outlet side 38 of the casing 30 towards the drive shaft 100, thereupon exiting the mixer 10 through the outlet 50.

Preferably the casing 30 further includes at least one casing extension 130 situated between the inlet end 32 and the outlet end 38 of the casing 30. The at least one casing extension 130 includes a cylindrical extension wall 140 and a middle annulus 150 projecting inwardly from the extension wall 140. The middle annulus 150 includes a central aperture 155 for accommodating the drive shaft 100 therethrough and has a plurality of the concentric rings 70 of the mixing pins 80 projecting towards the inlet and outlet ends 32,38.

The drive shaft 100, in such an embodiment, is further connected with an additional rotor disk 91 rotationally fixed within the casing 30 between distal ends 88 of the opposing pins 80 of the middle annulus 150 and the outlet end 38. The additional rotor disk 91 includes a plurality of the concentric rings 70 of mixing pins 80 projecting from both sides thereof towards the middle annulus 150 and the outer end 38. The concentric rings 70 of the additional rotor disk 91 are situated between the concentric rings of the middle annulus 150 and the outlet end 38. As such, the adhesive compound and air mixture must travel around the peripheral edge of each rotor disk 90,91 and through the aperture 155 of the middle annulus 150 before existing the mixer 10. Preferably the inlet end 32 and the outlet end 38 are each fixed with the casing extension 130 with a plurality of the mechanical fasteners 160 such as screws or bolts. Clearly additional casing extensions 130 may be added to the mixer 10 in a similar fashion, providing as many rotor disks 90,91 as necessary to accommodate a desired level of mixing of the adhesive compound 20 with the air 21.

In one embodiment, the leading edge 81 of each of the pins 80 of each rotor disk 90,91 are convex, such as with a radius edge of 0.0992 sq. inches, to further agitate the mixture of the adhesive compound 20 and the air 21 (compared with a flat leading edge 81 having a surface area of 0.0972 sq. inches, which is less desirable). The pins 80 may each be elongated and arcuate about the drive shaft 100 (FIG. 3). Preferably the ratio of the surface area of the pins 80, ends 32,38 and rotor disks 90,91 to the volume 60 within the casing 30 is between 60 and 70 square inches to between 2 and 3 liters, such as 64.7 sq. inches to 2.6 liters. With the casing extension 130 preferably the ratio of the surface area of the pins 80, ends 32,38 and rotor disks 90,91 to the volume 60 within the casing 30 is between 135 and 145 square inches to between 4.5 and 5.5 liters, such as 139.4 sq. inches to 5.1 liters. A higher the surface area with respect to the volume 60 is desirable for mixtures having a higher viscosity. In one embodiment having a single rotor disk 90, the mixer 10 includes 612 pin 80 on the rotor disk 90 and 692 pins 80 on the ends 32,38. An embodiment having a single additional rotor disk 91 may include 1224 rotor pins 80 and 1384 pins 80 on the ends 32,38 and middle annulus 150, for example.

Each of the roller bearings 120 is preferably removably mounted to the casing 30, such that when the outlet end 38 of the casing 30 is disassembled from the inlet end 32 of the casing 30, the rotor disk 90 and roller bearings 120 can be removed from the casing 120. This facilitates field maintenance of the bearings 120 and rotor disk 90, and allows for quickly replacing such parts if necessary.

A mounting frame 170 may be fixed with the inlet end 32 of the casing 30 and include at least one roller bearing 120 for rotationally receiving the drive shaft 100 therethrough. Such a mounting frame 170 further includes a plurality of mounting apertures 180 for mounting the mixer 10 on a flat surface 18, such as a table or workbench.

The inlet 40 may further include an adhesive compound inlet 190 (FIGS. 1 and 2) and an adjustable valve 200 above the compound inlet 190 for selectively adjusting the amount of air 21 introduced into the mixer 10 with the adhesive compound 20. The inlet end 32 of the casing 30, the outlet end 38 of the casing 30, and any of the casing extensions 130 each may further include a suspension ring 210 for facilitating lifting of the mixer 10 with a lifting tool (not shown).

While a particular form of the invention has been illustrated and described, it will be apparent that various modifications can be made without departing from the spirit and scope of the invention. For example, the shape, size, orientation, number and placement of the pins 80 may be changed to alter the dynamics of the mixing of the adhesive foam 22. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A continuous mixer for mixing an adhesive compound with air to produce an adhesive foam, comprising:

a casing having an inlet adjacent to an annular inlet end thereof and an outlet adjacent an opposing annular outlet end thereof, the casing further including a cylindrical exterior casing wall, the casing wall and ends defining a volume therein, the inlet end and outlet end each including a plurality of concentric rings of mixing pins projecting into the volume;

at least one rotor disk rotationally fixed within the casing between distal ends of the opposing pins, the at least one rotor disk including a plurality of the concentric rings of mixing pins projecting from both sides thereof towards the inlet and outlet ends, the concentric rings of the rotor disk situated between the concentric rings of the inlet and outlet ends, a leading edge of the pins of each rotor disk having a concave shape;

a drive shaft rotatably mounted in the casing and a fixed through the center of each of the at least one rotor disk, the drive shaft including at least one rotational seal that prevents the adhesive compound from escaping the casing; and a plurality of roller bearings for rotationally supporting the drive shaft and the at least one rotor disk within the casing;

whereby with a mixture of air and the adhesive compound introduced into the inlet and with the drive shaft rotationally coupled to a motor, the adhesive compound and air are thoroughly mixed into the adhesive foam as the mixture travels from the inlet between the pins of the inlet end and the opposing pins of the at least one rotor disk, around a peripheral edge of the at least one rotor disk, and back through the rotating pins of the at least one rotor disk and the opposing pins of the outlet end of the casing towards the drive shaft, thereupon exiting the mixer through the outlet.

2. The continuous mixer of claim 1 wherein the casing further includes at least one casing extension situated between the inlet end and the outlet end of the casing, the at least one casing extension including a cylindrical extension wall and a middle annulus projecting inwardly from the extension wall, the middle annulus including a central aperture for accommodating the drive shaft therethrough and having a plurality of the concentric rings of mixing pins projecting towards the inlet and outlet ends, the drive shaft further connected with an additional rotor disk rotationally fixed within the casing between distal ends of the opposing pins of the middle annulus and the outlet end, the additional rotor disk including a plurality of the concentric rings of mixing pins projecting from both sides thereof towards the middle annulus and outlet end, the concentric rings of the additional rotor disk situated between the concentric rings of the middle annulus and the outlet end;

whereby the mixture of air and the adhesive travels around the peripheral edge of each rotor disk and through the aperture of the middle annulus before exiting the mixer.

3. The continuous mixer of claim 1 wherein the inlet end of the casing is fixed with the outlet end of the casing with a plurality of mechanical fasteners.

4. The continuous mixer of claim 2 wherein the inlet end of the casing and the outlet end of the casing are each fixed with the casing extension with a plurality of mechanical fasteners, and wherein the additional rotor is fixed with an end of the drive shaft with a plurality of mechanical fasteners.

5. The continuous mixer of claim 2 including two of the casing extensions fixed between the inlet end and the outlet end of the mixer.

6. The continuous mixer of claim 1 wherein the ratio of surface area of the pins, ends and rotor disks to the volume within the casing is approximately 64.7 sq. inches to 2.6 liters.

7. The continuous mixer of claim 2 wherein the ratio of surface area of the pins, ends and rotor disks to the volume within the casing is approximately 139.4 sq. inches to 5.1 liters.

8. The continuous mixer of claim 3 wherein each of the roller bearings is removably mounted to the casing, whereby when the outlet end of the casing is disassembled from the inlet end of the casing, the rotor disk and roller bearings can be removed from the casing.

9. The continuous mixer of claim 1 further including a mounting frame fixed with the inlet end of the casing, the mounting frame including at least one roller bearing for rotationally receiving the drive shaft therethrough and further including a plurality of mounting apertures for mounting the mixer on a flat surface.

10. The continuous mixer of claim 1 wherein the inlet further includes an adhesive compound inlet and an adjustable valve above the compound inlet for selectively adjusting the amount of air introduced into the mixer with the adhesive compound.

11. The continuous mixer of claim 1 wherein the inlet end of the casing and the outlet end of the casing each include a suspension ring for facilitating lifting of the mixer with a lifting tool.

12. The continuous mixer of claim 2 wherein the inlet end of the casing, the casing extension, and the outlet end of the casing each include a suspension ring for facilitating lifting of the mixer with a lifting tool.

* * * * *